US009299507B2

(12) United States Patent
Yoshitomo et al.

(10) Patent No.: US 9,299,507 B2
(45) Date of Patent: Mar. 29, 2016

(54) GAS CIRCUIT BREAKER

(75) Inventors: Yuji Yoshitomo, Tokyo (JP); Toru Yamashita, Tokyo (JP); Daisuke Yoshida, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 106 days.

(21) Appl. No.: 13/979,153

(22) PCT Filed: May 17, 2011

(86) PCT No.: PCT/JP2011/061341

§ 371 (c)(1),
(2), (4) Date: Jul. 11, 2013

(87) PCT Pub. No.: WO2012/157081

PCT Pub. Date: Nov. 22, 2012

(65) Prior Publication Data

US 2013/0284703 A1 Oct. 31, 2013

(51) Int. Cl.
*H01H 3/46* (2006.01)
*H01H 33/14* (2006.01)
(Continued)

(52) U.S. Cl.
CPC ..... *H01H 3/46* (2013.01); *H01H 33/14* (2013.01); *H01H 33/91* (2013.01); *H01H 33/98* (2013.01); *H01H 33/42* (2013.01)

(58) Field of Classification Search
CPC ..... H01H 3/46; H01H 33/14; H01H 33/91; H01H 33/98
USPC ..... 218/2, 61, 68, 84
See application file for complete search history.

(56) References Cited

U.S. PATENT DOCUMENTS 5,451,731 A 9/1995 Yoshizumi et al.
5,902,978 A 5/1999 Zehnder et al.
(Continued)

FOREIGN PATENT DOCUMENTS

CN 101064226 A 10/2007
JP 58-144508 A 8/1983
(Continued)

OTHER PUBLICATIONS

International Search Report (PCT/ISA/210) issued on Aug. 30, 2011, by the Japanese Patent Office as the International Searching Authority for International Application No. PCT/JP2011/061341.
(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A mechanical-puffer-type arc-extinguishing chamber includes a fixed main contact, a movable main contact that moves on an opening-and-closing axis in a connectable and disconnectable manner to and from the fixed main contact, and a mechanical puffer chamber that is provided in the movable main contact and blows compressed insulation gas to an arc. A thermal-puffer-type arc-extinguishing chamber includes a fixed contact, a movable contact that moves on the opening-and-closing axis in a connectable and disconnectable manner to and from the fixed contact, and a thermal puffer chamber in which compressed insulation gas is blown to the arc. The mechanical-puffer-type arc-extinguishing chamber and the thermal-puffer-type arc-extinguishing chamber are arranged in series on the opening-and-closing axis, and two breaking portions are electrically connected in series.

5 Claims, 5 Drawing Sheets

(51) Int. Cl.

| | |
|---|---|
| ***H01H 33/91*** | (2006.01) |
| ***H01H 33/98*** | (2006.01) |
| *H01H 33/42* | (2006.01) |

(56) References Cited

U.S. PATENT DOCUMENTS

| | | | |
|---|---|---|---|
| 6,163,001 | A | 12/2000 | Zehnder et al. |
| 2004/0074875 | A1 | 4/2004 | Munakata et al. |

FOREIGN PATENT DOCUMENTS

| | | | |
|---|---|---|---|
| JP | 58-207802 | A | 12/1983 |
| JP | 59-63623 | A | 4/1984 |
| JP | 60-39726 | A | 3/1985 |
| JP | 60-189130 | A | 9/1985 |
| JP | 61-121222 | A | 6/1986 |
| JP | 5-182565 | A | 7/1993 |
| JP | 6-19941 | B2 | 3/1994 |
| JP | 6-196054 | A | 7/1994 |
| JP | 10-31944 | A | 2/1998 |
| JP | 11-329191 | A | 11/1999 |
| JP | 2001-67996 | A | 3/2001 |
| JP | 2001-195960 | A | 7/2001 |
| JP | 2003-281980 | A | 10/2003 |
| JP | 2003-348721 | A | 12/2003 |
| JP | 2007-200812 | A | 8/2007 |
| JP | 2010-232032 | A | 10/2010 |
| JP | 2010-282802 | A | 12/2010 |

OTHER PUBLICATIONS

Written Opinion (PCT/ISA/237) issued on Aug. 30, 2011, by the Japanese Patent Office as the International Searching Authority for International Application No. PCT/JP2011/061341.

Chinese Office Action dated Jan. 28, 2015 issued in corresponding Chinese Patent Appln. No. 2011800696591, with English translation (9 pages).

Office Action dated Aug. 13, 2015, issued by the Chinese Patent Office in corresponding Chinese Patent Application No. 201180069659.7, and an English translation of the Office Action. (9 pages).

GAS CIRCUIT BREAKER

FIELD

The present invention relates to a gas circuit breaker used in an electric power station.

BACKGROUND

Conventionally, in an electric power station such as an electric substation or a switching station, puffer-type gas circuit breakers that extinguish an arc generated between electrodes by using blowing of insulation gas have been employed. Among these conventional circuit breakers, a mechanical-puffer-type gas circuit breaker extinguishes an arc by compressing insulation gas in a mechanical puffer chamber by a mechanical operation and blowing the compressed insulation gas to the arc. Further, a thermal-puffer-type gas circuit breaker extinguishes an arc by blowing insulation gas to the arc, which is compressed by heat of the arc. In addition, a mechanical-puffer/thermal-puffer hybrid-type gas circuit breaker that employs the mechanical type and the thermal type in combination has also been practically used.

A mechanical-puffer/thermal-puffer hybrid-type gas circuit breaker described in Patent Literature 1 includes a first thermal puffer chamber that is provided at an inner side of a movable contact, a second thermal puffer chamber that is fixed to a container, which is filled with insulation gas, and is always communicated with the first thermal puffer chamber, and a mechanical puffer chamber that is provided in series with the first thermal puffer chamber at an inner side of a movable contact and communicated with the first thermal puffer chamber via a check valve.

In the gas circuit breaker described in Patent Literature 1, when breaking a large current, pressures of the first and second thermal puffer chambers are increased by thermal expansion of the circumferential gas due to an energy of the arc generated between electrodes. When the pressures of the first and second thermal puffer chambers are increased higher than a pressure of the mechanical puffer chamber, a communicating port between the first thermal puffer chamber and the mechanical puffer chamber is closed by the check valve, and the compressed insulation gas in the first and second thermal puffer chambers is blown to the arc. When breaking a small current, the pressure of the mechanical puffer chamber is increased higher than the pressures of the first and second thermal puffer chambers by a mechanical compression, and thus the check valve between the first thermal puffer chamber and the mechanical puffer chamber is opened, and the compressed insulation gas in the mechanical puffer chamber is blown to the arc through the first thermal puffer chamber. In this method, an excessive puffer pressure when breaking a larger current can be transferred from the first thermal puffer chamber to the second thermal puffer chamber, and thus a puffer reaction force can be reduced. With this configuration, a required operation force of an operation device can be reduced.

In the conventional mechanical-puffer-type gas circuit breaker, even when the arc energy when breaking a small current is not large enough, a pressure increase can be obtained by reducing a volume inside the mechanical puffer chamber, and thus a sufficient puffer pressure can be obtained so that current breaking can be easily achieved.

CITATION LIST

Patent Literature

Patent Literature 1: Japanese Patent Application Laid-open No. 2001-67996

SUMMARY

Technical Problem

However, in the mechanical-puffer/thermal-puffer hybrid-type gas circuit breaker described in Patent Literature 1 mentioned above, when breaking a small current, the energy of the arc generated between the electrodes is not large enough so that the pressures of the first and second thermal puffer chambers are not sufficiently increased, and thus the pressure of the insulation gas is decreased when the compressed insulation gas of the mechanical puffer chamber flows into the first thermal puffer chamber. Therefore, blowing of the insulation gas between the electrodes is weak, making it difficult to obtain a required breaking performance.

Furthermore, in the conventional mechanical-puffer-type gas circuit breaker, when breaking a large current, a considerably large puffer reaction force is generated due to an excessive energy of the arc generated between the electrodes, and thus the operation force of the operation device needs to be increased.

The present invention has been achieved in view of the above problems, and an object of the present invention is to provide a gas circuit breaker having an excellent breaking performance with a low operation force.

Solution to Problem

The present invention is directed to a gas circuit breaker that achieves the object. The gas circuit breaker includes a container that contains insulation gas in a sealed manner, a mechanical-puffer-type arc-extinguishing chamber within the container, and a thermal-puffer-type arc-extinguishing chamber within the container.

The mechanical-puffer-type arc-extinguishing chamber includes a first fixed contact that is fixed to the container; a first movable contact that moves on a straight line in a connectable and disconnectable manner to and from the first fixed contact; and a mechanical puffer chamber that is provided in the first movable contact, shrinks in volume when shutting off a current, to compress insulation gas therein, and blows the compressed insulation gas to an arc. The thermal-puffer-type arc-extinguishing chamber within the container includes a second fixed contact that is fixed to the container; a second movable contact that moves on the same straight line as the first movable contact in a connectable and disconnectable manner to and from the second fixed contact; and a thermal puffer chamber that is defined by the second fixed contact and the container, in which insulation gas therein is compressed by heating through an arc when shutting off a current, and blows the compressed insulation gas to the arc.

The mechanical-puffer-type arc-extinguishing chamber and the thermal-puffer-type arc-extinguishing chamber are arranged in series on the straight line, and a first breaking portion including the first fixed contact and the first movable contact and a second breaking portion including the second fixed contact and the second movable contact are electrically connected in series.

Advantageous Effects of Invention

The present invention can provide a gas circuit breaker having an excellent breaking performance with a low operation force.

DESCRIPTION OF EMBODIMENTS

Exemplary embodiments of a gas circuit breaker according to the present invention will be explained below in detail with reference to the accompanying drawings. The present invention is not limited to the embodiments.

First Embodiment

Figure 1:
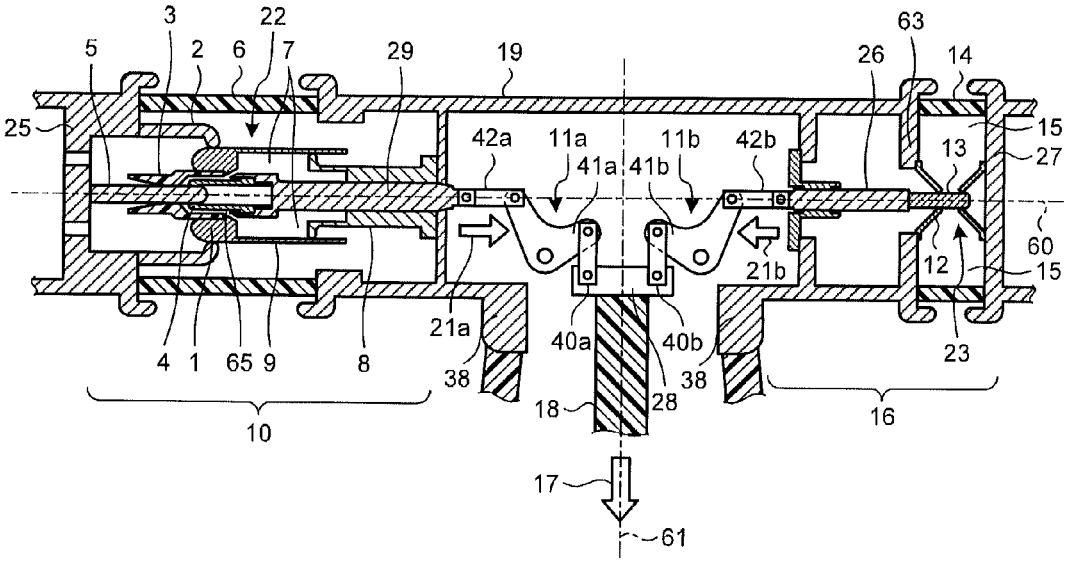
FIG. 1 is a cross-sectional configuration diagram of a gas circuit breaker according to a first embodiment in an initial state.
Figure 2:
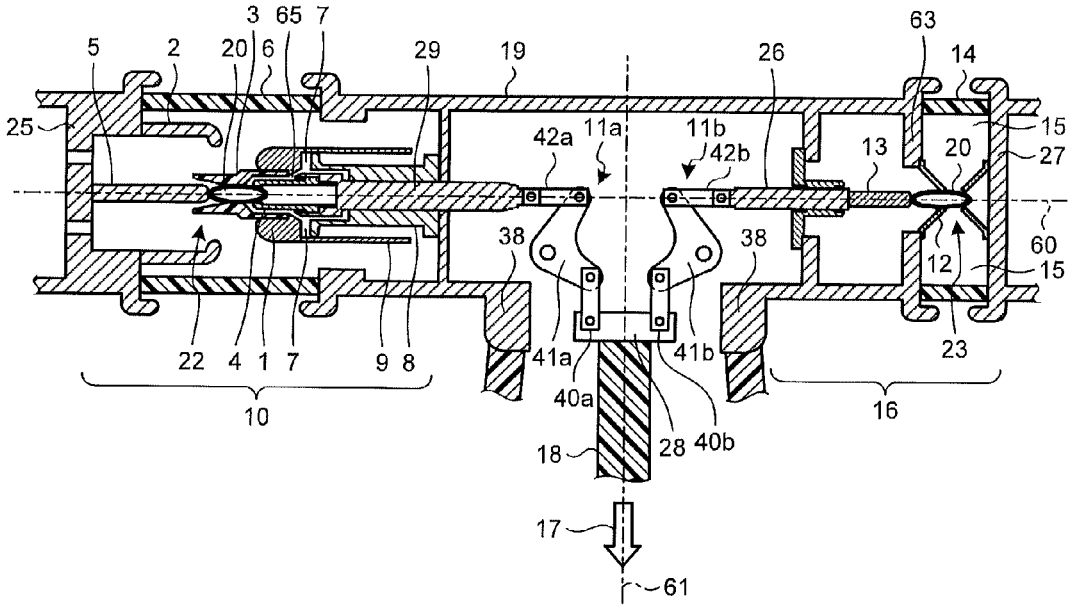
FIG. 2 is a cross-sectional configuration diagram of the gas circuit breaker according to the first embodiment in a breaking halfway state.

FIG. 1 is a cross-sectional configuration diagram of a gas circuit breaker according to a first embodiment of the present invention in an initial state, and FIG. 2 is a cross-sectional configuration diagram of the gas circuit breaker in a breaking halfway state. As shown in FIGS. 1 and 2, the gas circuit breaker according to the present embodiment is a circuit breaker of a so-called "double-break type", specifically having a structure including a mechanical-puffer-type arc-extinguishing chamber 10 and a thermal-puffer-type arc-extinguishing chamber 16 connected in series. That is, the mechanical-puffer-type arc-extinguishing chamber 10 and the thermal-puffer-type arc-extinguishing chamber 16 are arranged in series in a direction of an opening-and-closing axis 60, a breaking portion 22 (first breaking portion) in the mechanical-puffer-type arc-extinguishing chamber 10 and a breaking portion 23 (second breaking portion) in the thermal-puffer-type arc-extinguishing chamber 16 are electrically connected in series, and the structure is configured to break a current or shut off a current by at least one of the breaking portion 22 or the breaking portion 23.

The mechanical-puffer-type arc-extinguishing chamber 10 is defined by a movable-side frame 19, a fixed-side arc-extinguishing barrel 25, and an inter-electrode insulation tube 6. One end portion of the movable-side frame 19 is arranged to face the fixed-side arc-extinguishing barrel 25 in the direction of the opening-and-closing axis 60, and the inter-electrode insulation tube 6 is arranged between the movable-side frame 19 and the fixed-side arc-extinguishing barrel 25.

The thermal-puffer-type arc-extinguishing chamber 16 is defined by the movable-side frame 19, a fixed-side arc-extinguishing barrel 27, and an inter-electrode insulation tube 14. The other end portion of the movable-side frame 19 is arranged to face the fixed-side arc-extinguishing barrel 27 in the direction of the opening-and-closing axis 60, and the inter-electrode insulation tube 14 is arranged between the movable-side frame 19 and the fixed-side arc-extinguishing barrel 27.

The movable-side frame 19 is common to the mechanical-puffer-type arc-extinguishing chamber 10 and the thermal-puffer-type arc-extinguishing chamber 16. Each of the movable-side frame 19 and the fixed-side arc-extinguishing barrels 25 and 27 is formed of a tubular metal container. The movable-side frame 19, the fixed-side arc-extinguishing barrels 25 and 27, and the inter-electrode insulation tubes 6 and 14 are coaxially arranged around the opening-and-closing axis 60. Insulation gas such as $SF_6$ is sealed inside the mechanical-puffer-type arc-extinguishing chamber 10 and the thermal-puffer-type arc-extinguishing chamber 16.

An internal configuration of the mechanical-puffer-type arc-extinguishing chamber 10 is explained. The breaking portion 22 is provided in the mechanical-puffer-type arc-extinguishing chamber 10. The breaking portion 22 includes a fixed main contact 2 (first fixed contact) of a substantially cylindrical shape fixed to the fixed-side arc-extinguishing barrel 25, a fixed arc contact 5 fixed to the fixed-side arc-extinguishing barrel 25 and arranged at the inner side of the fixed main contact 2, a piston 8 fixed to the movable-side frame 19, a rod 29 (first rod) movably inserted into the piston 8 in a reciprocating manner along the opening-and-closing axis 60, a movable arc contact 4 of a substantially cylindrical shape provided on one end portion of the rod 29 at a side of the fixed arc contact 5 and configured to be connected and disconnected to and from the fixed arc contact 5, a puffer cylinder 9 integrally provided with the rod 29 and engaged with the piston 8, a movable main contact 1 (first movable contact) provided on one end portion of the puffer cylinder 9 at a side of the fixed main contact 2 and configured to be connected and disconnected to and from the fixed main contact 2, and an insulation nozzle 3 attached to one end portion of the puffer cylinder 9 at a side of the fixed arc contact 5.

The fixed main contact 2 is arranged coaxially with the opening-and-closing axis 60. The fixed arc contact 5 is rod-shaped and arranged on the opening-and-closing axis 60. The movable main contact 1 is integrally formed with the puffer cylinder 9 and the rod 29. An outer circumferential surface of the movable main contact 1 is brought into contact with the fixed main contact 2 in an initial state. An outer circumferential surface of the fixed arc contact 5 is brought into contact with the movable arc contact 4 in an initial state.

The piston 8 is arranged coaxially with the opening-and-closing axis 60. The rod 29 is slidably inserted into the piston 8, and the rod 29 moves on the opening-and-closing axis 60 in a reciprocating manner according to an initial state or a breaking state. In the mechanical-puffer-type arc-extinguishing chamber 10, a mechanical puffer chamber 7 is formed within the movable main contact 1. Specifically, the mechanical puffer chamber 7 is defined by the puffer cylinder 9 on which the movable main contact 1 is provided and the piston 8.

A gas flow path 65 is formed in the puffer cylinder 9 at a side of the fixed main contact 2. That is, the gas flow path 65 that is communicated with the mechanical puffer chamber 7 is provided between the movable arc contact 4 and the movable main contact 1, and the gas flow path 65 extends between the movable arc contact 4 and the insulation nozzle 3, such that the insulation gas within the mechanical puffer chamber 7 is guided to the insulation nozzle 3. The insulation gas compressed within the mechanical puffer chamber 7 is blown to the arc via the insulation nozzle 3.

An internal configuration of the thermal-puffer-type arc-extinguishing chamber 16 is explained next. An end portion 63 of the movable-side frame 19 at a side of the thermal-puffer-type arc-extinguishing chamber 16 includes an opening into which a movable contact 13 (second movable contact) is insertable, and faces an end surface of the fixed-side arc-extinguishing barrel 27.

A fixed contact 12 (second fixed contact) is provided on each of end surfaces of the end portion 63 of the movable-side frame 19 and the fixed-side arc-extinguishing barrel 27. Specifically, the fixed contact 12 provided on the end portion 63 of the movable-side frame 19 is formed of a plurality of elastic contact fingers arranged side by side surrounding the opening of the end portion 63 around the opening-and-closing axis 60, and each of the contact fingers extends at an angle from a fixed place on the movable-side frame 19 toward the opening-and-closing axis 60, to form a funnel shape as a whole.

The fixed contact 12 provided on the end surface of the fixed-side arc-extinguishing barrel 27 is provided facing the fixed contact 12 provided on the end portion 63 of the movable-side frame 19. That is, the fixed contact 12 provided on the end surface of the fixed-side arc-extinguishing barrel 27 is formed of a plurality of elastic contact fingers arranged side by side in the circumferential direction around the opening-and-closing axis 60, and each of the contact fingers extends at an angle from a fixed place on the fixed-side arc-extinguishing barrel 27 toward the opening-and-closing axis 60, to form a funnel shape as a whole.

The movable contact 13 is provided on one end portion of a rod 26 (second rod) at a side of the fixed contact 12. The movable contact 13 is rod shaped, and arranged on the opening-and-closing axis 60. The movable contact 13 is connected and disconnected to and from the fixed contact 12 by the rod 26 moving in a reciprocating manner in the direction of the opening-and-closing axis 60 according to an initial state and a breaking state. In this manner, the movable contact 13 moves on the opening-and-closing axis 60, that is, on the same straight line, similarly to the movable main contact 1. In the initial state, the fixed contact 12 of the fixed-side arc-extinguishing barrel 27 and the fixed contact 12 of the movable-side frame 19 are bridged, by which the fixed-side arc-extinguishing barrel 27 and the movable-side frame 19 are electrically connected to each other.

The movable contact 13 is lighter than the movable main contact 1. The weight of the rod 26 including the movable contact 13 is lighter than a total weight of the movable main contact 1, the movable arc contact 4, the puffer cylinder 9, and the rod 29. That is, a movable portion of the breaking portion 22 of the thermal-puffer-type arc-extinguishing chamber 16 is lighter than a movable portion of the breaking portion 23 of the mechanical-puffer-type arc-extinguishing chamber 10. As described later, the movable portion on a side of the thermal-puffer-type arc-extinguishing chamber 16 is not subject to a puffer reaction force at the time of breaking a current, and thus it can be more downsized and lightened than the movable portion on a side of the mechanical-puffer-type arc-extinguishing chamber 10.

A thermal puffer chamber 15 is defined as a space surrounded by the movable-side frame 19, the fixed-side arc-extinguishing barrel 27, the inter-electrode insulation tube 14, and the fixed contact 12. In order to prevent the insulation gas flowing from between the contact fingers of the fixed main contact 12, for example, a funnel-shaped cover (not shown) is provided on a surface of the fixed main contact 12 at a side of the thermal puffer chamber 15.

The configurations of the mechanical-puffer-type arc-extinguishing chamber 10 and the thermal-puffer-type arc-extinguishing chamber 16 are not limited to the examples shown in the drawings, and other configurations can be adopted so long as a similar arc-extinguishing function is provided.

An operation mechanism of the movable portion such as the movable main contact 1 and the movable contact 13 is explained next. As shown in FIGS. 1 and 2, an end portion of the rod 29 on a side where the movable main contact 1 is not provided, from among end portions of the rod 29, is coupled to one end portion of an insulation rod 18 via a link mechanism 11*a* (first link mechanism). Furthermore, an end portion of the rod 26 on a side where the movable contact 13 is not provided, from among end portions of the rod 26, is coupled to the one end portion of the insulation rod 18 via a link mechanism 11*b* (second link mechanism). The insulation rod 18 moves back and forth along an operation axis 61 set in a direction perpendicular to the opening-and-closing axis 60. The other end portion of the insulation rod 18 is connected to an operation device (not shown). The operation device operates opening and closing of the breaking portions 22 and 23, and by driving the operation device, the insulation rod 18 moves back and forth along the operation axis 61.

The link mechanism 11*a* converts an operation force in the direction of the operation axis 61 generated by the movement of the insulation rod 18 into a force in the direction of the opening-and-closing axis 60, which is perpendicular to the direction of the operation axis 61, and transfers the converted force to the breaking portion 22. Specifically, the link mechanism 11*a* includes a link 42*a* that is coupled to one end portion of the rod 29 and extends in the direction of the opening-and-closing axis 60, a link 40*a* that is coupled to one end portion (an end portion 28) of the insulation rod 18 and extends in the direction of the operation axis 61, and a substantially V-shaped lever 41*a* that is rotatably coupled to both the links 42*a* and 40*a*. Although the link 40*a* is provided as a pair to sandwich the end portion 28 of the insulation rod 18, only the link 40*a* on a front side is shown in the drawings, and the link 40*a* on a rear side is in a state of being hidden behind. Similarly, although the link 42*a* is provided as a pair to sandwich the one end portion of the rod 29, only the link 42*a* on the front side is shown in the drawings, and the link 42*a* on the rear side is in a state of being hidden behind. The pair of the links 40*a* are coupled to one end portion of the lever 41*a* with a pin to sandwich a single unit of the lever 41*a* in a direction perpendicular to the diagrams, and the pair of the links 42*a* are coupled to the other end portion of the lever 41*a* with a pin to sandwich the single unit of the lever 41*a* in the direction perpendicular to the diagrams. In this manner, the link mechanism 11*a* is configured to be symmetric in a direction perpendicular to both the opening-and-closing axis 60 and the operation axis 61. The configuration of the link mechanism 11*a* is not limited to the example shown in the drawings, and other types of configurations can be adopted.

The link mechanism 11*b* converts an operation force in the direction of the operation axis 61 generated by the movement of the insulation rod 18 into a force in the direction of the opening-and-closing axis 60, which is perpendicular to the direction of the operation axis 61, and transfers the converted force to the breaking portion 23. Specifically, the link mechanism 11*b* includes a link 42*b* that is coupled to one end portion of the rod 26 and extends in the direction of the opening-and-closing axis 60, a link 40*b* that is coupled to the end portion 28 of the insulation rod 18 and extends in the direction of the operation axis 61, and a substantially V-shaped lever 41*b* that is rotatably coupled to both the links 42*b* and 40*b*. Although the link 40*b* is provided as a pair to sandwich the end portion 28 of the insulation rod 18, only the link 40*b* on the front side is shown in the drawings, and the link 40*b* on the rear side is in a state of being hidden behind. Similarly, although the link 42*b* is provided as a pair to sandwich the one end portion of the rod 26, only the link 42*b* on the front side is shown in the drawings, and the link 42*b* on the rear side is in a state of being hidden behind. The pair of the links 40*b* are coupled to one end portion of the lever 41*b* with a pin to sandwich a single unit of the lever 41*b* in the direction perpendicular to the diagrams, and the pair of the links 42*b* are coupled to the other end portion of the lever 41*b* with a pin to sandwich the single unit of the lever 41*b* in the direction perpendicular to the diagrams. In this manner, the link mechanism 11*b* is configured to be symmetric in the direction perpendicular to both the opening-and-closing axis 60 and the operation axis 61. The configuration of the link mechanism 11*b* is not limited to the example shown in the drawings, and other types of configurations can be adopted.

The end portion 28 of the insulation rod 18 is, for example, an end portion including a metal member for attaching the links 40*a* and 40*b*. A metal sealing portion 38 that covers the end portion 28 of the insulation rod 18 in a circumferential direction around the operation axis 61 is provided on the movable-side frame 19. The sealing portion 38 is arranged to cover the end portion 28 in the circumferential direction regardless of a position of the end portion 28 in the direction of the operation axis 61 with the movement of the insulation rod 18.

An operation of the present embodiment is explained next with reference to FIGS. 1 and 2. In the initial state, the movable main contact 1 is in a state of being brought into contact with the fixed main contact 2, and the movable contact 13 is in a state of being brought into contact with the fixed contact 12 (see FIG. 1). Therefore, a current flows through a path formed by the fixed-side arc-extinguishing barrel 25, the fixed main contact 2, the movable main contact 1, the piston 8, the movable-side frame 19, the movable contact 13, the fixed contact 12, and the fixed-side arc-extinguishing barrel 27. In this manner, the breaking portion 22 and the breaking portion 23 are electrically connected in series via the movable-side frame 19. Therefore, it suffices that the current breaking is performed by any one of the thermal-puffer-type arc-extinguishing chamber 16 or the mechanical-puffer-type arc-extinguishing chamber 10.

In order to make a transition from an initial state to a breaking state, an operation force 17 is applied to the insulation rod 18 by driving an operation device (not shown). In the example shown in the drawings, the insulation rod 18 moves along the operation axis 61, for example, in a downward direction by the operation force 17. With the movement of the insulation rod 18, the movable main contact 1 and the movable contact 13 respectively move in opposite directions to each other commonly on the opening-and-closing axis 60 via the link mechanisms 11*a* and 11*b*. Specifically, the movable main contact 1 moves in a breaking direction 21*a* to be disconnected from the fixed main contact 2, and then when the movable arc contact 4 is disconnected from the fixed arc contact 5, an arc 20 is generated between the movable arc contact 4 and the fixed arc contact 5. The movable contact 13 moves in a direction of a breaking direction 21*b*, which is an opposite direction to the breaking direction 21*a*, to be disconnected from the fixed contact 12. At this time, the arc 20 is generated between the movable contact 13 and the fixed contact 12.

In the thermal-puffer-type arc-extinguishing chamber 16, ambient gas is heated by an energy of the arc that is generated between the contacts (between the movable contact 13 and the fixed contact 12), and due to thermal expansion by the heating of the ambient gas, a pressure in the thermal puffer chamber 15 is increased. When a current approaches the zero point so that the heating and the pressure increase are slowed down in the arc generating area, the compressed insulation gas within the thermal puffer chamber 15 flows to between the contacts from the thermal puffer chamber 15 at a high speed and is blown to the arc 20. With this operation, the arc 20 is extinguished and current is shut off. The current breaking in the thermal-puffer-type arc-extinguishing chamber 16 is more effective when the arc energy is large so that the insulation gas is more heated, but with the current breaking in a medium and small current area, the breaking performance is limited because the insulation gas is not heated sufficiently enough so that the pressure of the thermal puffer chamber 15 is not sufficiently increased.

Meanwhile, in the mechanical-puffer-type arc-extinguishing chamber 10, a volume of the mechanical puffer chamber 7 is shrunken due to a mechanical operation with the disconnection of the breaking portion 22, and thus the insulation gas within the mechanical puffer chamber 7 is compressed to have a high pressure. The compressed insulation gas within the mechanical puffer chamber 7 is then blown to the arc 20 via the gas flow path 65 and the insulation nozzle 3. With this operation, the arc 20 is extinguished and the current breaking is achieved.

In the mechanical-puffer-type arc-extinguishing chamber 10, even when the arc energy is not large enough at the time of small current breaking, a sufficient puffer presser can be obtained due to the volume shrinkage within the mechanical puffer chamber 7, so that the current breaking can be easily achieved. However, because the insulation gas in proximity to the arc 20 is flown back to the mechanical puffer chamber 7, a high pressure is generated within the mechanical puffer chamber 7. Therefore, a reaction force against the operation force 17 of an operation device (not shown) is generated due to the pressure increase within the mechanical puffer chamber 7.

On the other hand, in the thermal-putter-type arc-extinguishing chamber 16, because the movable portion such as the movable contact 13 is light-weighted and the movable portion has no components receiving pressures, such as the puffer cylinder 9, no puffer reaction force is generated. Therefore, the movable portion of the thermal-puffer-type arc-extinguishing chamber 16 can be operated with a small force.

As explained above, according to the present embodiment, by configuring a double-break configuration in which the mechanical-puffer-type arc-extinguishing chamber 10 that is suitable for the small current breaking and the thermal-puffer-type arc-extinguishing chamber 16 that is suitable for the large current breaking are connected in series, a high breaking performance can be achieved regardless of a magnitude of the current. That is, because the gas circuit breaker according to the present embodiment is a double-break gas circuit breaker, it suffices that the current breaking is performed by any one of the mechanical-puffer-type arc-extinguishing chamber 10 or the thermal-puffer-type arc-extinguishing chamber 16, so that the advantages of the mechanical-puffer-type arc-extinguishing chamber 10 and the thermal-puffer-type arc-extinguishing chamber 16 can be fully utilized. Accordingly, the breaking performance can be easily secured in a wide range from a large current to a small current.

Furthermore, according to the present embodiment, as compared to a conventional double-break gas circuit breaker, the puffer reaction force at the time of the large current breaking is reduced, and thus the operation force 17 of an operation device (not shown) can be reduced.

Figure 5:
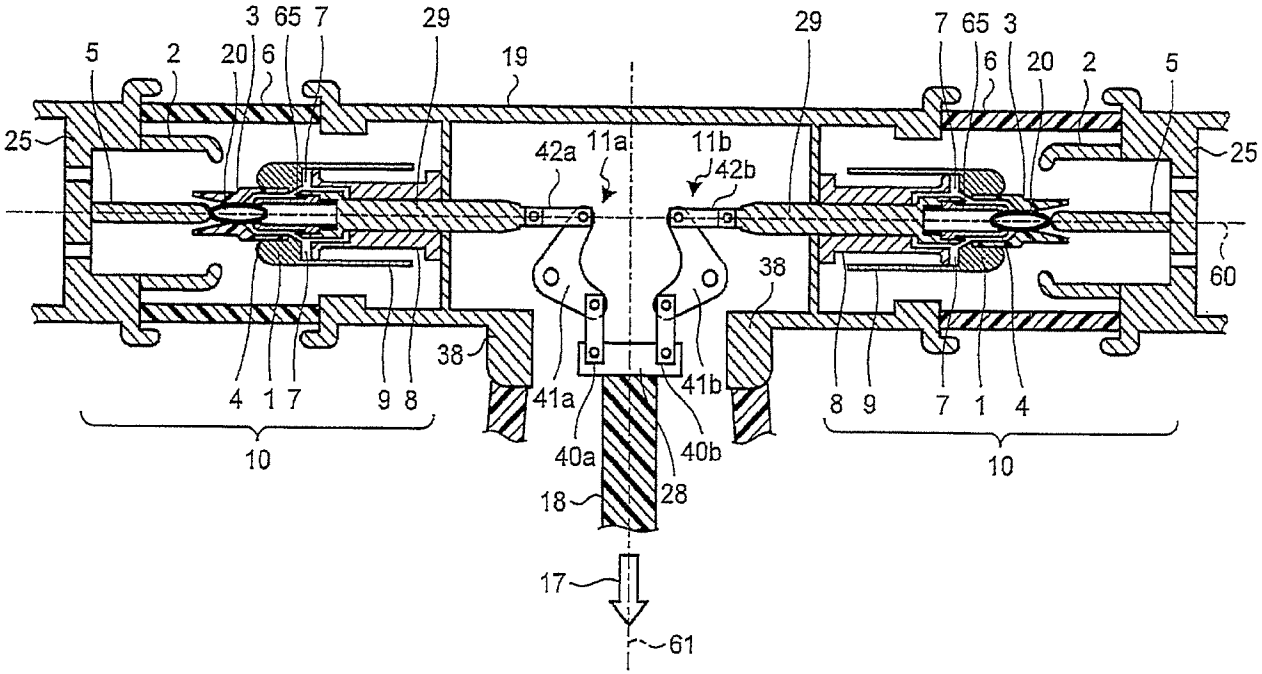
FIG.5 Prior Art
FIG. 5 is a cross-sectional configuration diagram of a conventional double-break gas circuit breaker in a breaking halfway state.

The present embodiment and a conventional gas circuit breaker are compared with each other. FIG. 5 is a cross-sectional configuration diagram of a conventional double-break gas circuit breaker in a breaking halfway state. In FIG. 5, constituent elements identical to those of FIGS. 1 and 2 are denoted by like reference signs. As shown in FIG. 5, in the conventional double-break gas circuit breaker, two mechanical-puffer-type arc-extinguishing chambers 10 are connected in series. Therefore, at the time of small current breaking, the current breaking can be easily achieved in a similar manner to the present embodiment. However, at the time of large current breaking, a puffer reaction force is generated within both the mechanical-puffer-type arc-extinguishing chambers 10, and thus a puffer reaction force twice as large as that of the present embodiment is generated, so that it is required to increase the operation force 17 to smoothly move movable portions.

On the other hand, in the present embodiment, because the breaking portion 23 is a thermal puffer type, no puffer reaction force is generated in the thermal-puffer-type arc-extinguishing chamber 16 and the movable portion of the thermal-puffer-type arc-extinguishing chamber 16 is lighter than the movable portion of the mechanical-puffer-type arc-extinguishing chamber 10, and thus the operation force 17 can be greatly reduced as compared to the conventional gas circuit breaker.

Figure 7:
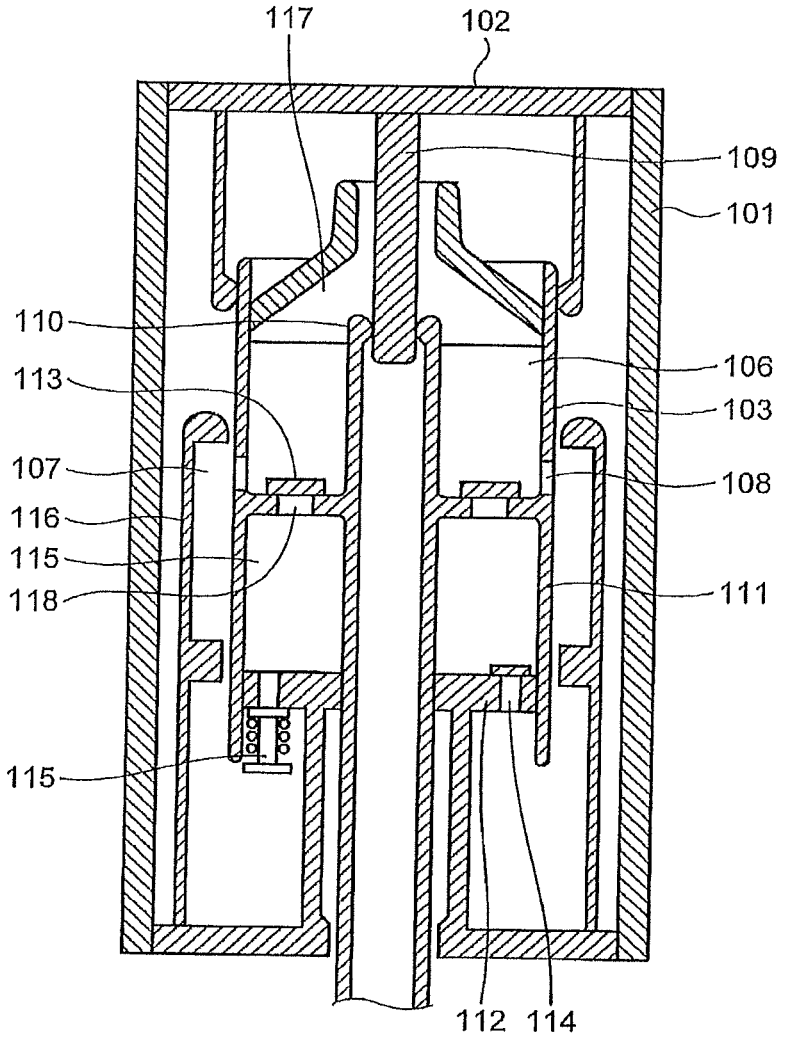
FIG.7 Prior Art
FIG. 7 is a cross-sectional configuration diagram of a gas circuit breaker described in Patent Literature 1 in an initial state.

As a gas circuit breaker that employs a mechanical-puffer/thermal-puffer hybrid-type structure in a similar manner to the present embodiment, the gas circuit breaker disclosed in Patent Literature 1 has been known. FIG. 7 is a cross-sectional configuration diagram of the gas circuit breaker described in Patent Literature 1 in an initial state. As shown in FIG. 7, an arc-extinguishing chamber of the gas circuit breaker includes a container 101, a fixed contact 102, a movable contact 103, and a casing 116. A fixed arc contact point 109 is provided on the fixed contact 102. The movable contact 103 includes a movable arc contact point 110, a first heating chamber 106, and a compressing chamber 115. The compressing chamber 115 includes a cylinder 111 and a piston 112. Meanwhile, on an outer side of the movable contact 103, a second heating chamber 107 is formed by the movable contact 103 and the casing 116. The first heating chamber 106 includes a communicating port 117 that is communicated with a tip of the movable arc contact point 110, a communicating port 118 that is communicated with the compressing chamber 115, and a communicating port 108 that is communicated with the second heating chamber 107. A check valve 113 is provided on the communicating port 118. Further, a check valve 114 and a control valve 115 are provided in the compressing chamber 115.

In the gas circuit breaker described in Patent Literature 1, at the time of large current breaking, pressures of the first heating chamber 106 and the second heating chamber 107 are increased by thermal expansion of ambient gas due to an arc energy. When the pressures of the first heating chamber 106 and the second heating chamber 107 are increased higher than a pressure of the compressing chamber 115, the communicating port 118 that is located between the first heating chamber 106 and the compressing chamber 115 is closed by the check valve 113, and the compressed insulation gas within the first heating chamber 106 and the second heating chamber 107 is blown to an arc through the communicating port 117. At the time of small current breaking, the pressure of the compressing chamber 115 is increased higher than the pressures of the first heating chamber 106 and the second heating chamber 107 by a mechanical compression, and thus the check valve 113 that is located between the first heating chamber 106 and the compressing chamber 115 is opened, and the compressed insulation gas within the compressing chamber 115 is blown to the arc through the communicating port 118, the first heating chamber 106, and the communicating port 117. In this gas circuit breaker, because an excessive puffer pressure at the time of the large current breaking can be let out from the first heating chamber 106 to the second heating chamber 107, the puffer reaction force can be reduced.

However, in the gas circuit breaker described in Patent Literature 1, at the time of the small current breaking, the arc energy is not large enough, and thus the pressures of the first heating chamber 106 and the second heating chamber 107 are not sufficiently increased, so that the pressure of the insulation gas is decreased when the compressed insulation gas within the compressing chamber 115 is flown to the first heating chamber 106. Therefore, blowing of the insulation gas to the arc is weak, so that it is not easy to obtain a required breaking performance.

On the other hand, in the present embodiment, by employing a configuration in which the mechanical-puffer-type arc-extinguishing chamber 10 and the thermal-puffer-type arc-extinguishing chamber 16 connected in series, which are separated from each other and independent of each other, even at the time of the small current breaking, the arc can be easily extinguished in the mechanical-puffer-type arc-extinguishing chamber 10.

In this manner, according to the present embodiment, it is possible to provide a gas circuit breaker having an excellent breaking performance from the large current to the small current with a low operation force.

Second Embodiment

As explained in the first embodiment, with the configuration shown in FIGS. 1 and 2, the movable portion of the thermal-puffer-type arc-extinguishing chamber 16 is lighter than the movable portion of the mechanical-puffer-type arc-extinguishing chamber 10, and thus when moving the insulation rod 18 in the downward direction by applying the operation force 17 to the insulation rod 18 at the time of breaking a current, a load that is biased toward the mechanical-puffer-type arc-extinguishing chamber 10 is applied as a whole to the end portion of the insulation rod 18 to which the link mechanisms 11*a* and 11*b* are coupled, and as a result, a force is exerted such that the insulation rod 18 is inclined from the operation axis 61 so that the breaking operation may not be smoothly performed. Therefore, it is desired to provide a mechanism for preventing the insulation rod 18 from being slanted.

Figure 6:
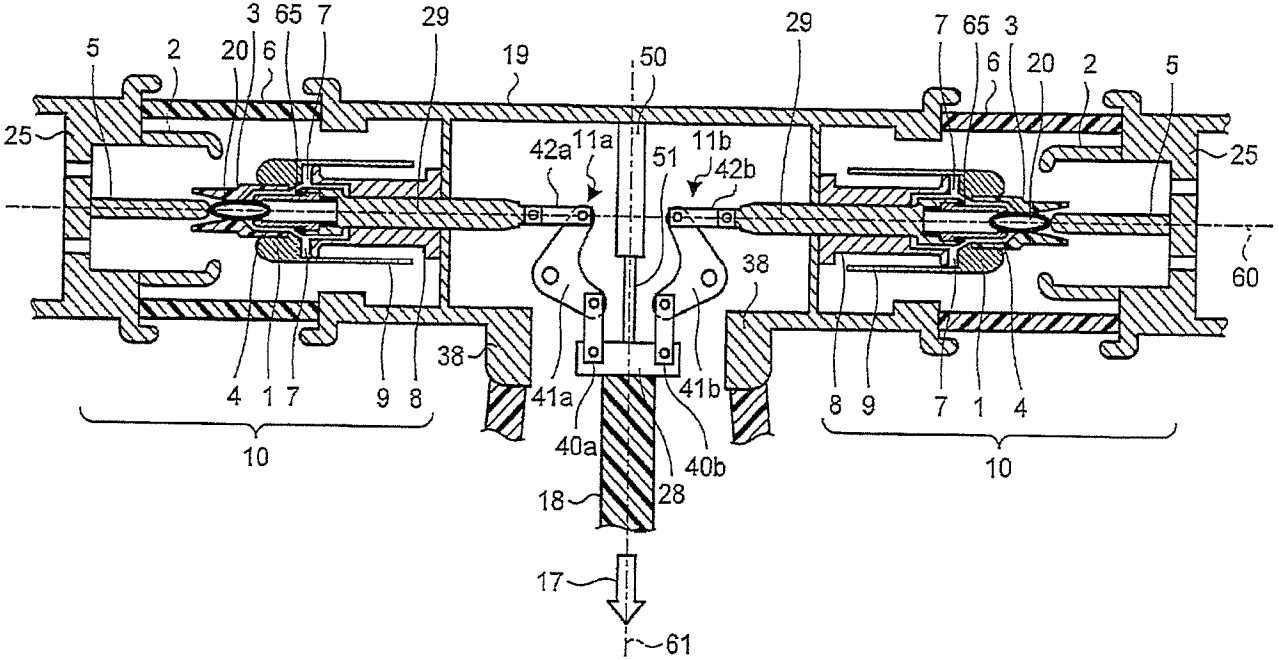
FIG.6 Prior Art
FIG. 6 depicts the conventional double-break gas circuit breaker shown in FIG. 5 in which a mechanism for preventing an insulation rod 18 from being slanted is provided.

FIG. 6 depicts the conventional double-break gas circuit breaker shown in FIG. 5 in which a mechanism for preventing the insulation rod 18 from being slanted is provided. In FIG. 6, constituent elements identical to those shown in FIG. 5 are denoted by like reference signs. As shown in FIG. 6, a shaft 51 that extends in the direction of the operation axis 61 is provided on the end portion of the insulation rod 18, and a tubular-shaped guide 50 into which the shaft 51 is slidably inserted in the direction of the operation axis 61 is attached to the movable-side frame 19. With this configuration, even when the loads applied to the link mechanisms 11*a* and 11*b* are laterally unbalanced, the force applied to the direction of the opening-and-closing axis 60 can be absorbed because the shaft 51 provided on the end portion of the insulation rod 18 is held by the guide 50, so that the insulation rod 18 can be prevented from being slanted. However, with this configuration, the guide 50 and the shaft 51, which are support components, extend from the end portion of the insulation rod 18 to the movable-side frame 19, resulting in an increase in size. To deal with this problem, in a second embodiment of the present invention, a mechanism for preventing the insulation rod 18 from being slanted as described below is applied to the gas circuit breaker according to the first embodiment.

Figure 3:
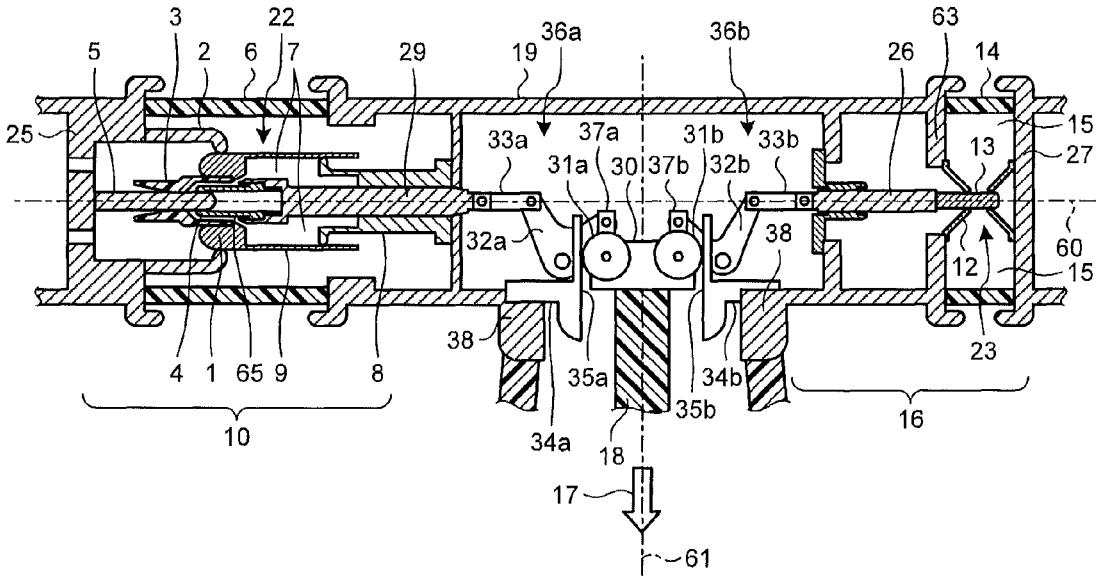
FIG. 3 is a cross-sectional configuration diagram of a gas circuit breaker according to a second embodiment in an initial state.
Figure 4:
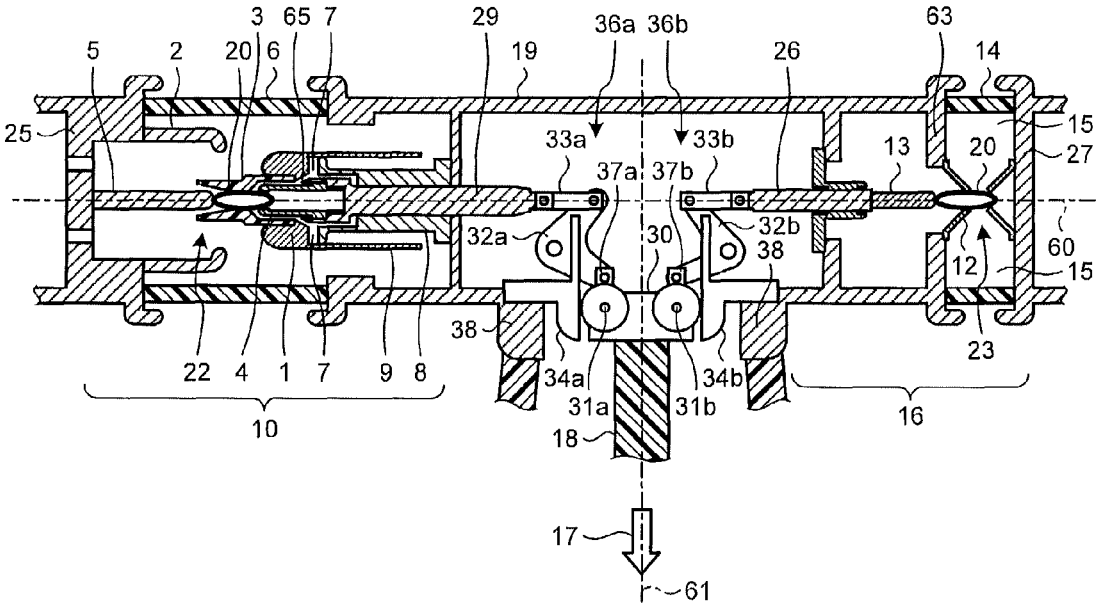
FIG. 4 is a cross-sectional configuration diagram of the gas circuit breaker according to the second embodiment in a breaking halfway state.

FIG. 3 is a cross-sectional configuration diagram of the gas circuit breaker according to the present embodiment in an initial state, and FIG. 4 is a cross-sectional configuration diagram of the gas circuit breaker in a breaking halfway state. In FIGS. 4 and 5, like constituent elements as those in FIGS. 1 and 2 are denoted by like reference signs. Features of the present embodiment that are different from those of the first embodiment are mainly explained below.

As shown in FIGS. 3 and 4, link mechanisms 36*a* and 36*b* are provided on an end portion 30 that is one end portion of the insulation rod 18. The link mechanism 36*a* transfers the operation force 17 applied to the insulation rod 18 to the rod 29, which corresponds to the link mechanism 11*a* according to the first embodiment. The link mechanism 36*b* transfers the operation force 17 applied to the insulation rod 18 to the rod 26, which corresponds to the link mechanism 11*b* according to the first embodiment.

The link mechanism 36*a* includes a link 33*a* that is coupled to one end portion of the rod 29 and extends to the direction of the opening-and-closing axis 60, a link 37*a* that is coupled to the end portion 30 of the insulation rod 18 and extends in the direction of the operation axis 61, and a substantially V-shaped lever 32*a* that is rotatably coupled to both the links 33*a* and 37*a*. Although the link 37*a* is provided as a pair to sandwich the end portion 30 of the insulation rod 18, only the link 37*a* on the front side is shown in the drawings, and the link 37*a* on the rear side is in a state of being hidden behind. Similarly, although the link 33*a* is provided as a pair to sandwich the one end portion of the rod 29, only the link 33*a* on the front side is shown in the drawings, and the link 33*a* on the rear side is in a state of being hidden behind. The pair of the links 37*a* are coupled to one end portion of the lever 32*a* with a pin to sandwich a single unit of the lever 32*a* in the direction perpendicular to the diagrams, and the pair of the links 33*a* are coupled to the other end portion of the lever 32*a* with a pin to sandwich the single unit of the lever 32*a* in the direction perpendicular to the diagrams. In this manner, the link mechanism 36*a* is configured to be symmetric in a direction perpendicular to both the opening-and-closing axis 60 and the operation axis 61. The configuration of the link mechanism 36*a* is not limited to the example shown in the drawings, and other types of configurations can be adopted.

Similarly, the link mechanism 36*b* includes a link 33*b* that is coupled to one end portion of the rod 26 and extends to the direction of the opening-and-closing axis 60, a link 37*b* that is coupled to the end portion 30 of the insulation rod 18 and extends in the direction of the operation axis 61, and a substantially V-shaped lever 32*b* that is rotatably coupled to both the links 33*b* and 37*b*. Although the link 37*b* is provided as a pair to sandwich the end portion 30 of the insulation rod 18, only the link 37*b* on the front side is shown in the drawings, and the link 37*b* on the rear side is in a state of being hidden behind. Similarly, although the link 33*b* is provided as a pair to sandwich the one end portion of the rod 26, only the link 33*b* on the front side is shown in the drawings, and the link 33*b* on the rear side is in a state of being hidden behind. The pair of the links 37*b* are coupled to one end portion of the lever 32*b* with a pin to sandwich a single unit of the lever 32*b* in the direction perpendicular to the diagrams, and the pair of the links 33*b* are coupled to the other end portion of the lever 32*b* with a pin to sandwich the single unit of the lever 32*b* in the direction perpendicular to the diagrams. In this manner, the link mechanism 36*b* is configured to be symmetric in a direction perpendicular to both the opening-and-closing axis 60 and the operation axis 61. The configuration of the link mechanism 36*b* is not limited to the example shown in the drawings, and other types of configurations can be adopted.

As shown in the drawings, the lever 32*b* (second lever) at the side of the thermal-puffer-type arc-extinguishing chamber 16 can be more downsized and lightened than the lever 32*a* (first lever) at the side of the mechanical-puffer-type arc-extinguishing chamber 10. That is, by setting a width of an arm of the lever 32*b* smaller than a width of an arm of the lever 32*a*, the lever 32*b* is made lighter than the lever 32*a*. As explained in the first embodiment, because the puffer reaction force is generated in the mechanical-puffer-type arc-extinguishing chamber 10 at the time of breaking a current, the weight of the movable portion of the mechanical-puffer-type arc-extinguishing chamber 10 is heavier than that of the thermal-puffer-type arc-extinguishing chamber 16. Therefore, the lever 32*b* can be lightened for the movable portion at the side of the thermal-puffer-type arc-extinguishing chamber 10.

A roller 31*a* (first roller) that is rotatably supported with a rotation axis in the direction perpendicular to both the direction of the opening-and-closing axis 60 and the direction of the operation axis 61 is provided on the end portion 30 at the side of the mechanical-puffer-type arc-extinguishing chamber 10. The roller 31*a* is provided as a pair on both sides in a direction of the rotation axis, that is, at the front side and the rear side in the drawings. That is, the rollers 31*a* are provided symmetrically in the direction perpendicular to both the opening-and-closing axis 60 and the operation axis 61. The rotation axis of the roller 31*a* is common to a coupling axis of the link mechanism 36*a* on the end portion 30, so that the roller 31*a* is arranged in proximity to the link mechanism 36*a*.

Furthermore, a roller 31*b* (second roller) that is rotatably supported with a rotation axis in the direction perpendicular to both the direction of the opening-and-closing axis 60 and the direction of the operation axis 61 is provided on the end portion 30 at the side of the thermal-puffer-type arc-extinguishing chamber 16. The roller 31*b* is provided as a pair on both sides in a direction of the rotation axis, that is, at the front side and the rear side in the drawings. That is, the rollers 31*b* are provided symmetrically in the direction perpendicular to both the opening-and-closing axis 60 and the operation axis 61. The rotation axis of the roller 31*b* is common to a coupling axis of the link mechanism 36*b* on the end portion 30, so that the roller 31*b* is arranged in proximity to the link mechanism 36*b*.

Roller guide portions 34*a* and 34*b* are attached to the movable-side frame 19. The roller guide portion 34*a* (first roller guide portion) is arranged at the side of the mechanical-puffer-type arc-extinguishing chamber 10 with respect to the insulation rod 18. The roller guide portion 34*b* (second roller guide portion) is arranged on the side of the thermal-puffer-type arc-extinguishing chamber 16 with respect to the insulation rod 18.

The roller guide portion 34*a* includes a guide plane 35*a* (first guide plane) that is brought into contact with circumferential surfaces of the pair of the rollers 31*a* and causes the pair of the rollers 31*a* to roll in the direction of the operation axis 61. Further, the roller guide portion 34*b* includes a guide plane 35*b* (second guide plane) that is brought into contact with circumferential surfaces of the pair of the rollers 31*b* and causes the pair of the rollers 31*b* to roll in the direction of the operation axis 61. The guide plane 35*a* and the guide plane 35*b* face each other in the direction of the opening-and-closing axis 60. The roller guide portions 34*a* and 34*b* are symmetrically arranged with respect to a plane that includes the operation axis 61, a normal line parallel to the opening-and-closing axis 60, and a substantially T-shaped cross section in the example shown in the drawings. Each of normal lines of the guide planes 35*a* and 35*b* is parallel to the opening-and-closing axis 60. Each of lengths of the guide planes 35*a* and 35*b* in the direction of the operation axis 61 is set such that the rollers 31*a* and 31*b* are not dropped off in a movement range of the insulation rod 18. The roller guide portion 34*a* can be provided as a pair with respect to the pair of the rollers 31*a* or as a single unit. The same holds true for the roller guide portions 34*b*.

The end portion 30 of the insulation rod 18 is, for example, an end portion including a metal member for attaching the links 37*a* and 37*b*. The metal sealing portion 38 that covers the end portion 30 of the insulation rod 18 in a circumferential direction around the operation axis 61 is provided on the movable-side frame 19. The sealing portion 38 is arranged to cover the end portion 30 in the circumferential direction regardless of a position of the end portion 30 in the direction of the operation axis 61 with the movement of the insulation rod 18.

An operation of the present embodiment is explained. At the time of breaking a current, at the time of breaking the current, when the operation force 17 is applied to the insulation rod 18, the rollers 31*a* and 31*b* provided on the end portion 30 are respectively guided by the guide planes 35*a* and 35*b*, the insulation rod 18 smoothly moves in the downward direction along the direction of the operation axis 61.

According to the present embodiment, although the load applied to the end portion 30 of the insulation rod 18 is biased as a whole toward the mechanical-puffer-type arc-extinguishing chamber 10, it is configured that the lateral load from the rollers 31*a* and 31*b* are absorbed by the roller guide portions 34*a* and 34*b*, so that the insulation rod 18 can be prevented from being slanted.

According to the present embodiment, sizes of the rollers 31*a* and 31*b* and the roller guide portions 34*a* and 34*b* are smaller as compared to the configuration including the guide 50 and the shaft 51 having sized according to the distance from the load point to the holding portion, and thus the insulation rod 18 can be prevented from being slanted with a relatively small component.

According to the present embodiment, the rollers 31*a* and 31*b* respectively roll on the guide planes 35*a* and 35*b*, and thus a friction generated when the insulation rod 18 moves is smaller as compared to the case shown in FIG. 6, so that the arc can be extinguished without lowering the moving speed of the movable main contact 1 and the movable contact 13.

Other configurations, operations, and effects of the present embodiment are as explained in the first embodiment.

INDUSTRIAL APPLICABILITY

As described above, the gas circuit breaker according to the present invention is useful as a gas circuit breaker that is used in an electric substation or a switching station and has an excellent breaking performance with a low operation force.

REFERENCE SIGNS LIST

1 movable main contact
2 fixed main contact
3 insulation nozzle
4 movable arc contact
5 fixed arc contact
6, 14 inter-electrode insulation tube
7 mechanical putter chamber
8 piston
9 puffer cylinder
10 mechanical-puffer-type arc-extinguishing chamber
11*a*, 11*b*, 36*a*, 36*b* link mechanism
12 fixed contact
13 movable contact
15 thermal puffer chamber
16 thermal-puffer-type arc-extinguishing chamber
17 operation force
18 insulation rod
19 movable-side frame
20 arc
22, 23 breaking portion
25, 27 fixed-side arc-extinguishing barrel
26, 29 rod
30 end portion
31*a*, 31*b* roller
33*a*, 33*b*, 40*a*, 40*b*, 42*a*, 42*b* link
32*a*, 32*b*, 41*a*, 41*b* lever
34*a*, 34*b* roller guide portion
35*a*, 35*b* guide plane
50 guide
51 shaft
60 opening-and-closing axis
61 operation axis
63 end portion
65 gas flow path

The invention claimed is:

1. A gas circuit breaker comprising:

a container that contains insulation gas in a sealed manner;

a mechanical-puffer-type arc-extinguishing chamber within the container that includes:

a first fixed contact that is fixed to the container;

a first movable contact that moves on a straight line in a connectable and disconnectable manner to and from the first fixed contact; and a mechanical puffer chamber that is provided in the first movable contact, shrinks in volume when shutting off a current, to compress insulation gas therein, and blows the compressed insulation gas to an arc; and a thermal-puffer-type arc-extinguishing chamber, having a mechanical configuration different from the mechanical-puffer-type arc-extinguishing chamber, within the container that includes:

a second fixed contact that is fixed to a fixed side arc-extinguishing barrel that contacts the container;

a second movable contact that moves on the same straight line as the first movable contact in a connectable and disconnectable manner to and from the second fixed contact; and a thermal puffer chamber that is defined by the second fixed contact and the fixed side arc-extinguishing barrel, in which insulation gas in the fixed side arc-extinguishing barrel is expanded by heating through an arc when shutting off a current, and blows the expanded insulation gas to the arc, wherein the mechanical-puffer-type arc-extinguishing chamber and the thermal-puffer-type arc-extinguishing chamber are arranged in series on the straight line, and wherein a first breaking portion including the first fixed contact and the first movable contact and a second breaking portion including the second fixed contact and the second movable contact are electrically connected in series.

2. The gas circuit breaker according to claim 1, further comprising:

an insulation rod that moves back and forth in a direction perpendicular to a movement direction of the first and second movable contacts;

a first link mechanism that is coupled to one end portion of the insulation rod and coupled to one end portion of a first rod on which the first movable contact is provided, and when an operation force is applied to the insulation rod, transfers the operation force to the first rod to move the first movable contact; and a second link mechanism that is coupled to the one end portion of the insulation rod and coupled to one end portion of a second rod on which the second movable contact is provided, and when an operation force is applied to the insulation rod, transfers the operation force to the second rod to move the second movable contact in a direction opposite to the movement direction of the first movable contact.

3. The gas circuit breaker according to claim 2, wherein a weight of a movable portion within the mechanical-puffer-type arc-extinguishing chamber including the first movable contact and the first rod is heavier than a weight of a movable portion within the thermal-puffer-type arc-extinguishing chamber including the second movable contact and the second rod.

4. The gas circuit breaker according to claim 3, further comprising:

a pair of first rollers that is provided on the one end portion of the insulation rod on a side of the mechanical-puffer-type arc-extinguishing chamber, and rotatably supported with a rotation axis in a direction perpendicular to both a movement direction of the first and second movable contacts and a movement direction of the insulation rod, the pair of first rollers being each provided on both sides of the one end portion in a direction of the rotation axis;

a pair of second rollers that is provided on the one end portion of the insulation rod on a side of the thermal-puffer-type arc-extinguishing chamber, and rotatably supported with a rotation axis in the direction perpendicular to both the movement direction of the first and second movable contacts and the movement direction of the insulation rod, the pair of second rollers being each provided on both sides of the one end portion in the direction of the rotation axis;

a first roller guide portion that is arranged on the side of the mechanical-puffer-type arc-extinguishing chamber with respect to the insulation rod, and includes a first guide plane for causing the pair of first rollers to roll in the movement direction of the insulation rod; and a second roller guide portion that is arranged on the side of the thermal-puffer-type arc-extinguishing chamber with respect to the insulation rod, and includes a second guide plane for causing the pair of second rollers to roll in the movement direction of the insulation rod, the second guide plane facing the first guide plane in the movement direction of the first and second movable contacts.

5. The gas circuit breaker according to claim 4, wherein the first link mechanism includes a first lever, and wherein the second link mechanism includes a second lever that is lighter than the first lever.

* * * * *